US009954283B2

(12) United States Patent
Orihara

(10) Patent No.: US 9,954,283 B2
(45) Date of Patent: Apr. 24, 2018

(54) ANTENNA DEVICE AND ELECTRONIC APPARATUS

(71) Applicant: Dexerials Corporation, Shinagawa-ku, Tokyo (JP)

(72) Inventor: Katsuhisa Orihara, Utsunomiya (JP)

(73) Assignee: Dexerials Corporation, Shinagawa-ku, Tokyo (JP)

( * ) Notice: Subject to any disclaimer, the term of this patent is extended or adjusted under 35 U.S.C. 154(b) by 1 day.

(21) Appl. No.: 15/032,114

(22) PCT Filed: Oct. 28, 2014

(86) PCT No.: PCT/JP2014/079154

§ 371 (c)(1),
(2) Date: Apr. 26, 2016

(87) PCT Pub. No.: WO2015/064762

PCT Pub. Date: May 7, 2015

(65) Prior Publication Data

US 2016/0268685 A1 Sep. 15, 2016

(30) Foreign Application Priority Data

Oct. 31, 2013 (JP) ..... 2013-226407

(51) Int. Cl.
*H01Q 1/24* (2006.01)
*H01Q 7/00* (2006.01)
(Continued)

(52) U.S. Cl.
CPC ..... *H01Q 7/00* (2013.01); *H01Q 1/243* (2013.01); *H01Q 1/38* (2013.01); *H01Q 7/06* (2013.01)

(58) Field of Classification Search
CPC ..... H01Q 1/24; H01Q 1/243; H01Q 7/00; H01Q 7/06
See application file for complete search history.

(56) References Cited

U.S. PATENT DOCUMENTS 7,495,625 B2 * 2/2009 Endo ..... G06K 7/10336 340/572.5
2013/0147675 A1 * 6/2013 Kato ..... H01Q 1/38 343/788

FOREIGN PATENT DOCUMENTS

JP 2006-295981 A 10/2006
JP 2011-211309 A 10/2011
(Continued)

OTHER PUBLICATIONS

Dec. 16, 2014, International Search Report issued in the International Patent Application No. PCT/JP2014/079154.

*Primary Examiner* — Hoang Nguyen
(74) *Attorney, Agent, or Firm* — Kenja IP Law PC

(57) ABSTRACT

An antenna device and an electronic apparatus are provided that enable a smaller casing and more stable communication by effectively using a magnetic shielding effect of a metal plate, regardless of internal structure or relationship of other components in a mobile apparatus. Included therein is an antenna coil (12) bisected into one side section and another side section of a loop antenna (11) along an edge of a magnetic sheet (110) attached to an inner wall surface of a metal body (111) disposed at a distant position relative to an antenna (121) of an opposing external device. The one side section of the loop antenna (11) opposes the magnetic sheet (110) and the other side section of the loop antenna (11) opposes the metal body (111) disposed at the distant position.

7 Claims, 12 Drawing Sheets

(51) Int. Cl.
*H01Q 7/06* (2006.01)
*H01Q 1/38* (2006.01)

(56) References Cited

FOREIGN PATENT DOCUMENTS

| | | | |
|---|---|---|---|
| JP | 4883125 | B2 | 2/2012 |
| JP | 4894945 | B2 | 3/2012 |
| JP | 5135450 | B2 | 2/2013 |
| JP | 2013-115647 | A | 6/2013 |

* cited by examiner

ANTENNA DEVICE AND ELECTRONIC APPARATUS

CROSS-REFERENCE TO RELATED APPLICATION

This application claims priority of Japanese Patent Application No. 2013-226407 (filed on Oct. 31, 2013), the entire disclosure of which is incorporated herein by reference.

TECHNICAL FIELD

The present disclosure relates to an antenna device that is incorporated into an electronic apparatus and that is configured to communicate with an external device via an electromagnetic field signal, and to the electronic apparatus into which the antenna device is incorporated.

BACKGROUND

Electronic apparatuses, such as a cellular phones, smart phones, and tablet PCs, have traditionally employed an antenna module for RFID (Radio Frequency Identification) to provide the function of short-distance contactless communication.

This antenna module communicates by making use of inductive coupling to an antenna coil incorporated into a transmitter, such as a reader/writer. In other words, this antenna device can drive IC that converts a magnetic field which an antenna coil receives from the reader/writer into electric power, thereby functioning as a communication processor.

For reliable communication, the antenna module needs to receive at least a certain value of magnetic flux from the reader/writer via the antenna coil. Therefore, an antenna device according to a known example is provided with a loop coil in the cellular phone and receives magnetic flux from the reader/writer via this *coli*.

In the antenna module incorporated into an electronic apparatus such as a cellular phone, metal such as a substrate in the apparatus, a battery pack, or the like receives the magnetic field from a reader/writer, thereby generating eddy current that repels the magnetic flux from the reader/writer. For example, considering the casing surface of a cellular phone, the magnetic field coming from the reader/writer tends to strengthen at the periphery portion of the casing surface and weaken near the center of the casing surface.

In the case of an antenna using the regular loop coil, the opening of the loop coil is positioned in the central portion of the cellular phone, where there is little reception of the above-described magnetic field that passes through the periphery portion of the casing surface. Therefore, with an antenna using a regular loop coil, the efficiency of receiving a magnetic field is poor.

Therefore, an Antenna device in which the loop antenna is disposed in the peripheral portion of the casing surface, where the magnetic field from the reader/writer is strong, and an antenna device that uses a magnetic sheet to increase magnetic flux and enhance performance have been proposed. In these antenna devices, the loop antenna is shaped to be rectangular, with the long sides disposed along the outer peripheral edge of the casing surface (for example, see PTL 1-3).

CITATION LIST

Patent Literature

PTL 1: JP4883125
PTL 2: JP4894945
PTL 3: JP5135450

SUMMARY

Technical Problem

One example of an antenna device that uses a magnetic field shielding effect of metal to improve efficiency is proposed by the applicant of the present application in Japanese Patent Application No. 2013-021616. The antenna device includes a first metal plate disposed inside a casing of an electronic apparatus and opposing an external device, an antenna coil disposed inside the casing of the electronic apparatus and configured to inductively couple with the external device, and a sheet-shaped second metal foil disposed inside the casing of the electronic apparatus such as to overlap with or be in contact with the first metal plate and overlap with at least part of a surface of the antenna coil at an opposite side of the antenna coil to a surface that faces the external device.

In the antenna device described above that uses a magnetic field shielding effect of metal to improve efficiency, the mounting position of the antenna coil is important because the magnetic field shielding effect of metal can be used to improve efficiency by mounting the antenna coil at a position near an edge of a metal plate.

However, in the case of a mobile apparatus, the edge of a metal plate typically coincides with the edge of the mobile apparatus due to the internal structure of the mobile apparatus. Furthermore, metal plates or metal bodies are often present in multiple layers, which is problematic in terms that the effect of being disposed substantially at the edge cannot be gained due to the influence of a distant layer relative to an opposing antenna.

In light of the conventional problems such as described above, an objective of the present disclosure is to provide an antenna device and an electronic apparatus that enable a smaller casing and more stable communication by maintaining antenna performance through a positional relationship of an antenna coil and a metal plate forming a main edge in substantially the same plane, regardless of a positional relationship of the antenna coil and a metal plate disposed at a distant position relative to an opposing antenna, and effectively using a magnetic shielding effect of the metal plates.

Other aspects of this disclosure and the specific advantages obtained with this disclosure will become clearer from the explanation of the embodiments described below.

Solution to Problem

An antenna device according to the present disclosure is incorporated into an electronic apparatus in which metal bodies are arranged in multiple layers and is configured to communicate with an external device via an electromagnetic field signal. The antenna device includes an antenna coil bisected into one side section and another side section of a loop antenna along an edge of a magnetic sheet attached to an inner wall surface of a metal body disposed at a distant position relative to an antenna of an opposing external device. The one side section of the loop antenna opposes the magnetic sheet and the other side section of the loop antenna opposes the metal body disposed at the distant position.

The antenna device according to the present disclosure may further include a second magnetic sheet that at a side corresponding to the one side section of the antenna coil, is disposed closer than the antenna coil to the magnetic sheet and opposing the one side section of the antenna coil, and at a side corresponding to the other side section of the antenna coil, is disposed closer than the antenna coil to the external device and opposing the other side section of the antenna coil, a third magnetic sheet disposed closer than the antenna coil to the magnetic sheet and opposing the one side section of the antenna coil, or a fourth magnetic sheet disposed closer than the antenna coil to the external device and opposing the other side section of the antenna coil.

In an electronic apparatus according to the present disclosure, metal bodies are arranged in multiple layers and an antenna device is incorporated therein that is configured to communicate with an external device via an electromagnetic field signal. The electronic apparatus includes a magnetic sheet attached to an inner wall surface of a metal body disposed at a distant position relative to an antenna of an opposing external device and an antenna coil that is bisected into one side section and another side section of a loop antenna along an edge of the magnetic sheet. The one side section of the loop antenna opposes the magnetic sheet and the other side section of the loop antenna opposes the metal body disposed at the distant position.

In the electronic apparatus according to the present disclosure, the magnetic sheet may be attached to the inner wall surface of the metal body so as to cover from a center line of the antenna coil to a front edge of the metal body.

The electronic apparatus according to the present disclosure may further include a second magnetic sheet that at a side corresponding to the one side section of the antenna coil, is disposed closer than the antenna coil to the magnetic sheet and opposing the one side section of the antenna coil, and at a side corresponding to the other side section of the antenna coil, is disposed closer than the antenna coil to the external device and opposing the other side section of the antenna coil, a third magnetic sheet disposed closer than the antenna coil to the magnetic sheet and opposing the one side section of the antenna coil, or a fourth magnetic sheet disposed closer than the antenna coil to the external device and opposing the other side section of the antenna coil.

Advantageous Effect

According to the present disclosure, an antenna device and an electronic apparatus are provided that enable a smaller casing and more stable communication by maintaining antenna performance through a positional relationship of an antenna coil and a metal plate forming a main edge in substantially the same plane, regardless of a positional relationship of the antenna coil and a metal plate disposed at a distant position relative to an opposing antenna, and effectively using a magnetic shielding effect of the metal plates.

DETAILED DESCRIPTION

Figure 1:
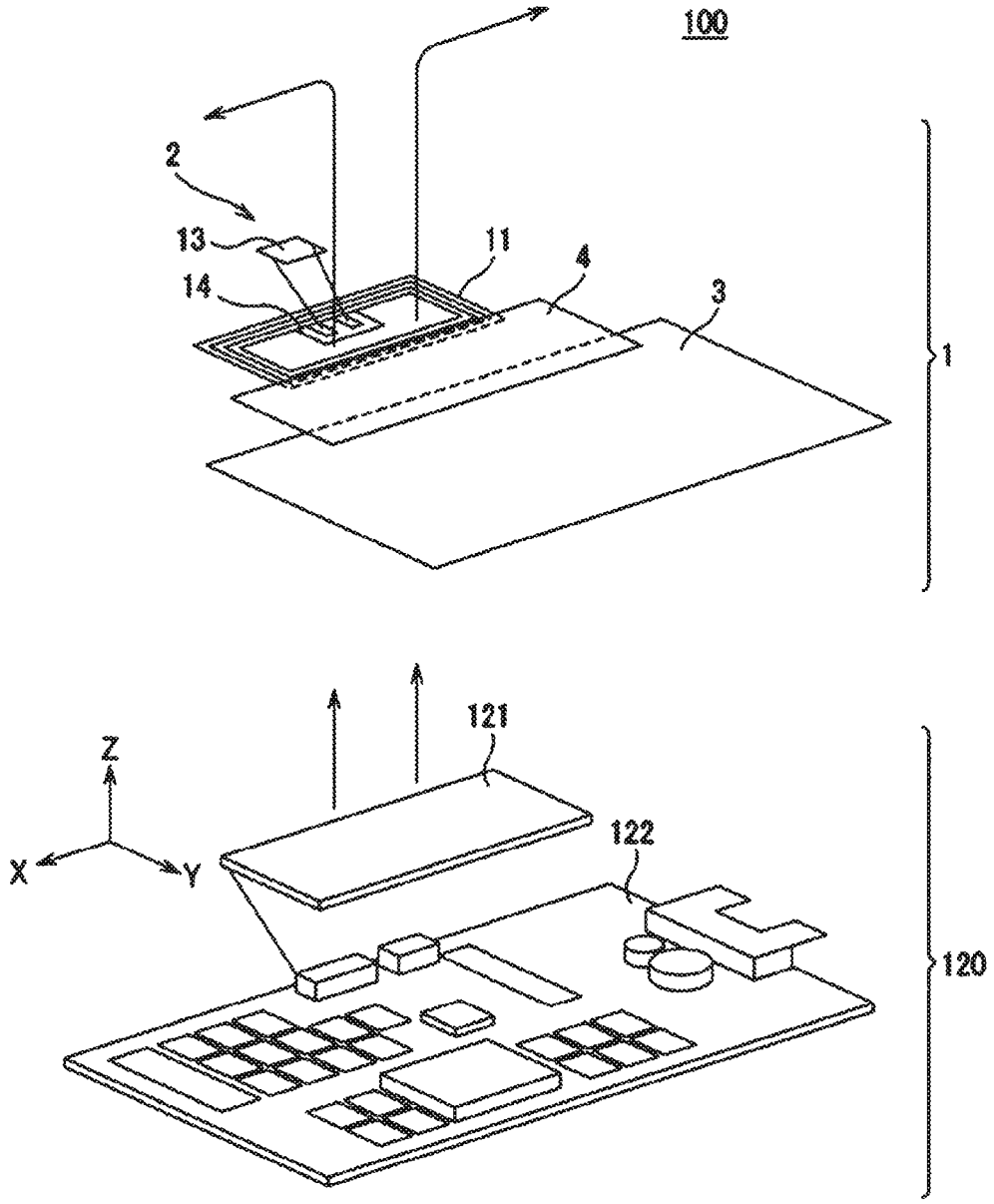
FIG. 1 is a perspective view illustrating an overview of configuration of a wireless communication system to which the present disclosure is applied.

Embodiments of this disclosure are described below in detail with reference to the drawings. It should be noted that this disclosure is not limited to the following embodiments, and various modifications may of course be made without deviating from the scope of this disclosure. Moreover, the drawings are schematic, and the ratios of dimensions in the drawings may differ from the actual ratios. Specific dimensions and the like should be determined in light of the following description. Furthermore, the relationship between dimensions and the ratio thereof may of course differ between drawings.

An antenna device according to this disclosure is a device incorporated into an electronic apparatus and configured to communicate with an external device via an electromagnetic field signal. This antenna device is, for example, used by being incorporated into a wireless communication system 100 for RFID (Radio Frequency Identification) as illustrated in FIG. 1.

The wireless communication system 100 includes an antenna device 1 and a reader/writer 120 configured to access the antenna device 1. Here, the antenna device 1 and the reader/writer 120 are arranged so as to oppose each other in the XY plane of a three-dimensional orthogonal coordinate system XYZ.

The reader/writer 120 functions as a transmitter configured to transmit a magnetic field in the Z axis direction to the antenna device 1 opposing the reader/writer 120 in the XY plane. Specifically, the reader/writer 120 includes an antenna 121 configured to transmit a magnetic field to the antenna device 1 and a control substrate 122 configured to communicate with the antenna device 1 inductively coupled through the antenna 121.

In other words, the reader/writer 120 is provided with the control substrate 122 that is electrically connected to the antenna 121. On this control substrate 122, a control circuit including one or a plurality of electronic parts, such as integrated circuit chips, is mounted. The control circuit performs various kinds of processing based on data received from the antenna device 1. For example, when transmitting data to the antenna device 1, the control circuit encodes the data, modulates a carrier wave of a predetermined frequency (for example, 13.56 MHz) based on the encoded data, amplifies the modulated signal, and drives the antenna 121 with the amplified modulated signal. Furthermore, when reading out data from the antenna device 1, the control circuit amplifies a modulated signal of data received by the antenna 121, demodulates the amplified modulated signal of the data, and decodes the demodulated data. The control circuit uses an encoding scheme and modulation scheme that are employed in common reader/writers, such as Manchester encoding and ASK (Amplitude Shift Keying) modulation.

Hereinafter, an antenna device and the like in the contactless communication system 100 are described, but the antenna device and the like may of course be applied similarly to a contactless charging system, such as a Qi (Chee) system.

The antenna device 1 is incorporated inside a casing of an electronic apparatus, such as a cellular phone, which is arranged so as to oppose the reader/writer 120 in the XY plane at the time of communication. The antenna device 1 includes an antenna module 2 incorporated inside the casing of the electronic apparatus and configured to communicate with the inductively coupled reader/writer 120, a metal plate 3 as a first conductor that is disposed inside the casing of the electronic apparatus, and that opposes the reader/writer 120, and a metal foil 4 as a sheet-shaped second conductor disposed inside the casing of the electronic apparatus, overlapping or in contact with the metal plate 3, and at least partially overlapping a surface of a loop antenna 11 of the antenna module 2, the surface being opposite to a surface facing the reader/writer 120.

The antenna module 2 includes the loop antenna 11 capable of communicating with the inductively coupled reader/writer 120, and a communication processor 13 configured to be driven by a current flowing through the loop antenna 11 and to communicate with the reader/writer 120.

On the loop antenna 11, an antenna coil 12 and a terminal 14 are mounted. The antenna coil 12 is formed by patterning a flexible lead wire, such as a flexible flat cable, and the terminal 14 electrically connects the antenna coil 12 to the communication processor 13.

Figure 2:
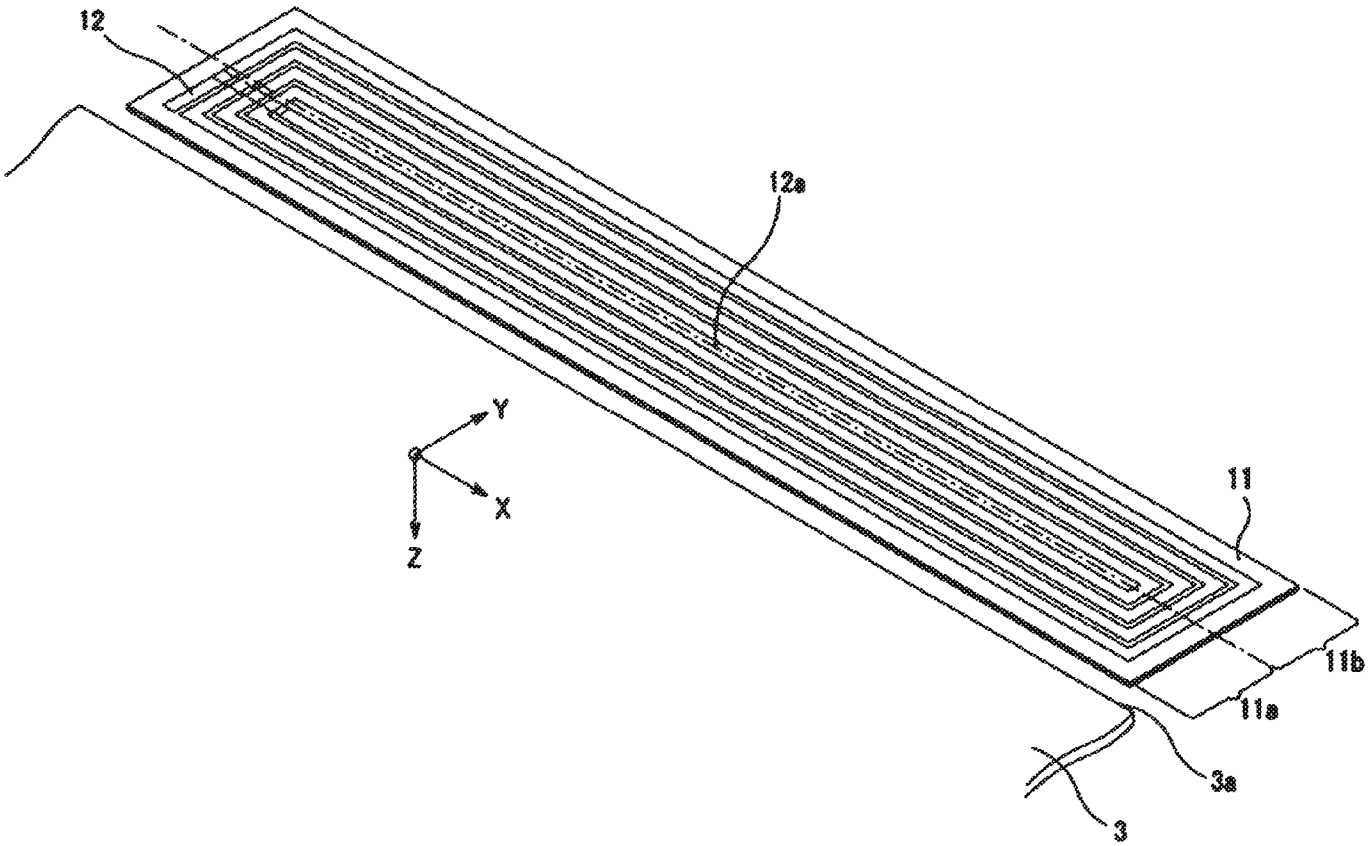
FIG. 2 is a perspective view illustrating an antenna substrate and a metal plate in the wireless communication system.

Here, the antenna device 1 is describe as having a basic structure in which the loop antenna 11 has an approximately rectangular shape as illustrated in FIG. 2, and a single lead wire of the antenna coil 12 is wound around along the external shape of the antenna coil 12.

The loop antenna 11 is disposed so that a principal surface of the loop antenna 11 on which the antenna coil 12 loops around is arranged faces the reader/writer 120 in the XY plane at the time of communication. The loop antenna 11 is divided at the central section 12*a* of the antenna coil 12 into one side section 11*a*, on which the lead wire of the antenna coil 12 is wound so that current flowing along the longitudinal direction of the antenna coil 12 flows in one direction, and another side section 11*b*, on which the lead wire of the antenna coil 12 is wound so that the current flowing along the longitudinal direction flows in the opposite direction. The loop antenna 11 is disposed so that one side edge along the longitudinal direction of the antenna coil faces the metal plate 3, i.e. so that the one side section 11*a* or the other side section 11*b* faces the metal plate 3.

When receiving a magnetic field transmitted from the reader/writer 120, the loop antenna 11 is magnetically coupled to the reader/writer 120 by inductive coupling, thereby receiving a modulated electromagnetic wave, and sending the received signal to the communication processor 13 via the terminal.

The communication processor 13 is driven by current flowing in the loop antenna 11 and communicates with the reader/writer 120. Specifically, the communication processor 13 demodulates a received modulated signal, decodes the demodulated data, and writes the decoded data to an internal memory of the communication processor 13. Furthermore, the communication processor 13 reads out data, which are to be transmitted to the reader/writer 120, from the internal memory, encodes the read-out data, modulates a carrier wave based on the encoded data, and transmits a modulated radio wave to the reader/writer 120 via the antenna coil 11 magnetically coupled to the reader/writer 120 by inductive coupling.

Instead of being driven by electric power flowing through the loop antenna 11, the communication processor 13 may be driven by electric power supplied from electric power supply means, such as a battery pack incorporated into the electronic apparatus, an external power source, or the like.

Figure 3:
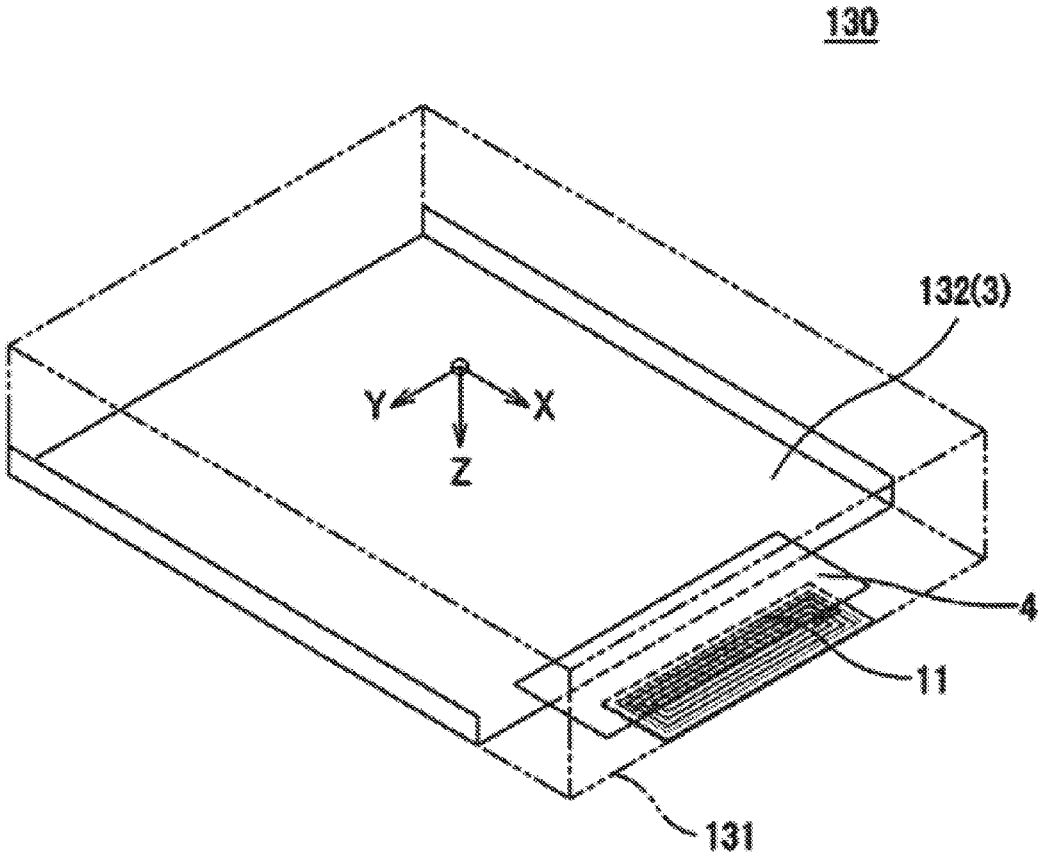
FIG. 3 is a perspective view illustrating an example of the inside of an electronic apparatus in the wireless communication system in a situation in which a metal cover attached to the inside of a casing is used as a first conductor.
Figure 4:
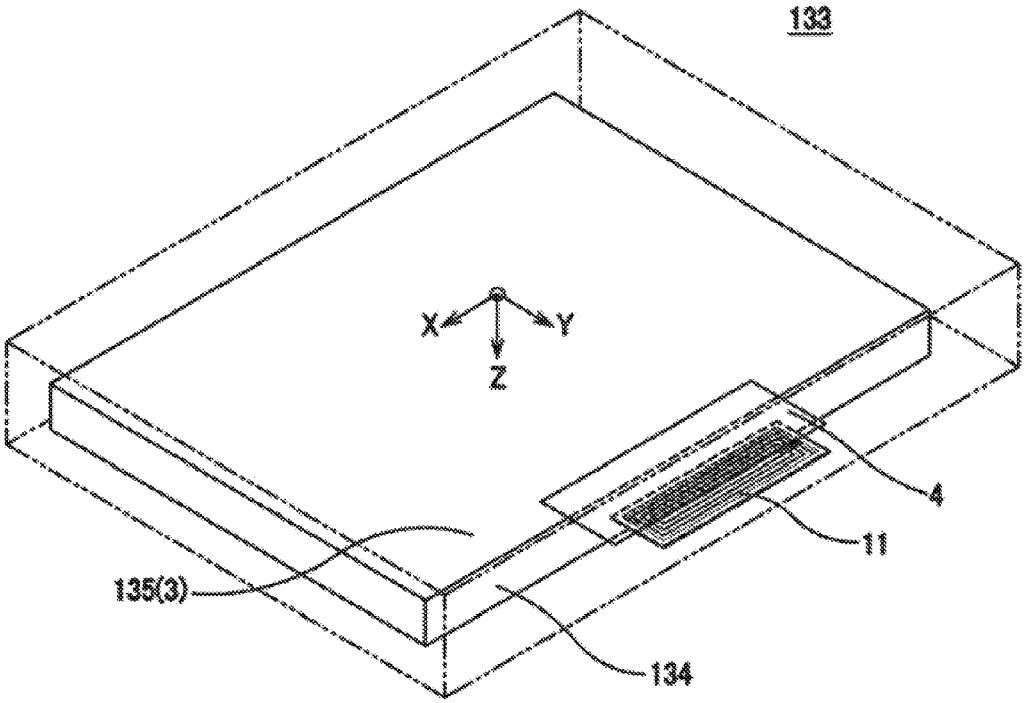
FIG. 4 is a perspective view illustrating an example of the inside of the electronic apparatus in the wireless communication system in a situation in which a metal casing of a battery pack is used as a first conductor.
Figure 5:
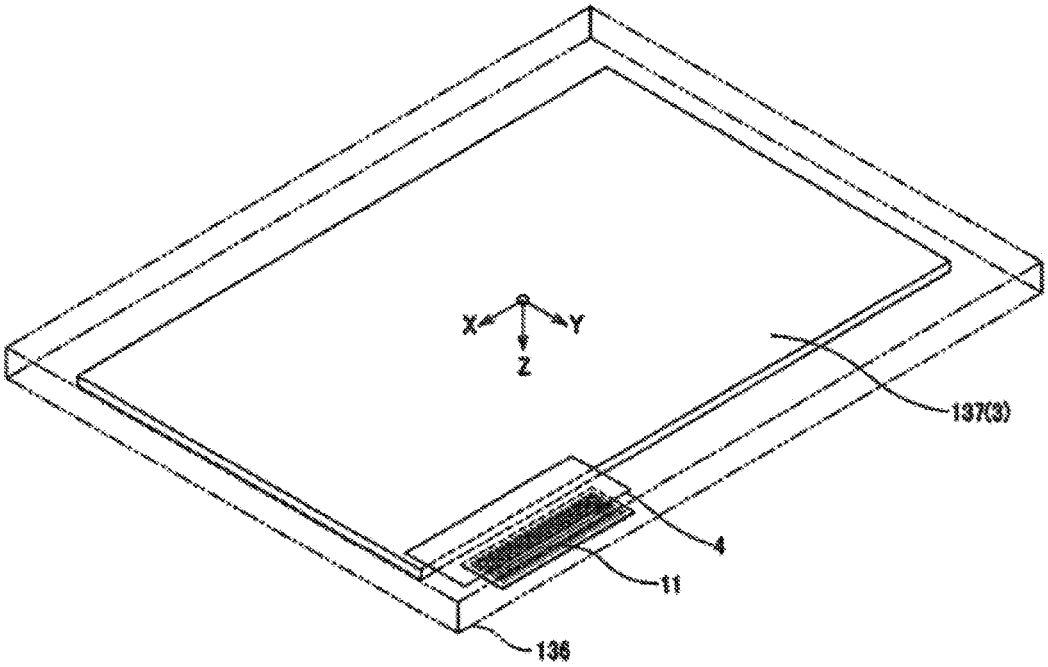
FIG. 5 is a perspective view illustrating an example of the inside of the electronic apparatus in the wireless communication system in a situation in which a metal plate on a rear surface of a liquid-crystal module is used as a first conductor.

The metal plate 3 constitutes a first conductor which is disposed in the casing of an electronic apparatus, such as a cellular phone, a smart phone, or a tablet PC, and opposes the reader/writer 120 at the time of communication through the antenna module 2. The first conductor for example corresponds to a metal cover 132 attached to an inner surface of a casing 131 of a smart phone 130 as illustrated in FIG. 3, a metal casing 135 of a battery pack 134 housed in a smart phone 133 as illustrated in FIG. 4, or a metal plate 137 disposed on a rear surface of a liquid-crystal module of a tablet PC 136 as illustrated in FIG. 5. Hereinafter, mainly taking smart phone 133 as an example of the electronic apparatus, the following describes how, in the metal casing of the battery pack 134 housed in the smart phone 133, the principal surface facing the reader/writer 120 at the time of communication serves as the metal plate 3 constituting the first conductor.

Figure 6A:
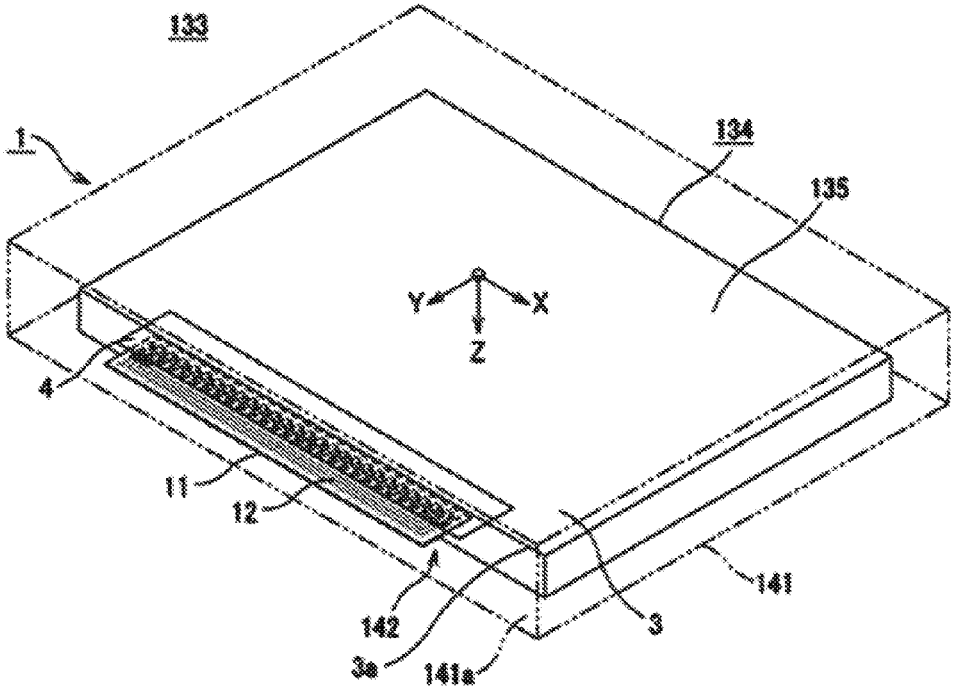
FIG. 6A is a perspective view and FIG. 6B is a side view, each illustrating an antenna device incorporated into the electronic apparatus.

In order to reduce the smart phone 133 in size while achieving good communication characteristics with the reader/writer 120 when the loop antenna 11 of the antenna module 2 is incorporated in the smart phone 133, the loop antenna 11 is disposed, in the XY plane of a three-dimensional orthogonal coordinate system XYZ as illustrated in FIG. 6A, for example, in a space 142 between the battery pack 134 disposed inside of an outer casing 141 of the smart phone 133 and an inner circumference wall 141*a* of the outer casing 141. Specifically, the loop antenna 11 is disposed between the inner circumference wall 141*a* of the outer casing 141 and an end portion 3*a* of the metal plate 3 of the metal casing 135 of the battery pack 134 as illustrated in FIG. 6B, the metal plate opposes the reader/writer 120.

Figure 6B:
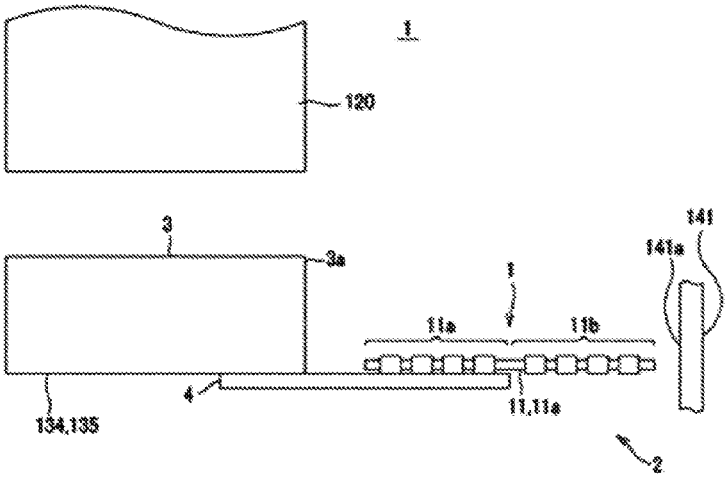

Here, the metal plate 3 constituting the metal casing of the battery pack 134 disposed in the smart phone 133 as illustrated in the cross-sectional view of FIG. 6B allows electricity to flow therethrough comparatively easily. Therefore, an eddy current is generated when an AC magnetic field is applied from the outside, thereby repelling the magnetic field. Examining the magnetic field distribution obtained by such addition of AC magnetic field from outside reveals that the end portion 3*a* of the battery pack 134, the metal plate 3 opposing the reader/writer 120, characteristically has a stronger magnetic field.

To achieve good communication characteristics by taking advantage of such strength characteristics of the magnetic field inside of the casing 131 of the smart phone 130, for example, the central section 12*a* parallel to the X axis is disposed to pass through the space 142 between the end portion 3*a* of the metal plate 3 and the inner circumference wall 141*a* of the outer casing 141, as illustrated in FIG. 2, and one side edge in the longitudinal direction is oriented toward the end portion 3*a* of the metal plate 3; in other words, the one side section 11*a* is oriented toward the end portion 3*a* of the metal plate 3.

At the time, the loop antenna 11 may be disposed at a position separated from the end portion 3*a* of the metal plate 3, so as not to touch the end portion 3*a* of the metal plate 3. Thus, even in the case where the metal plate 3 and the loop antenna 11 are disposed in such a way as to be separated from each other due to the constraints of the layout of the casing of the electronic apparatus, the overlapping of metal foil 4 with the metal plate 3 and with the loop antenna 11 allows the antenna device 1 to achieve good communication characteristics.

The loop antenna 11 may, however, be in contact with the metal plate 3. Furthermore, the loop antenna 11 may overlap with the metal plate 3. At this time, it is beneficial to arrange the loop antenna 11 so that the one side section 11*a* overlapped with the below-described metal foil 4 overlaps the metal plate 3, whereas the other side section 11*b* does not overlap with the metal plate 3. If the other side section 11*b* and the metal plate 3 overlap each other, there is a risk of inhibiting the inductive coupling between the other side section 11*b* and magnetic flux of the reader/writer 120.

Between the loop antenna 11 and the metal plate 3, the metal foil 4 is provided to serve as a sheet-shaped second conductor, the metal foil 4 overlapping or being in contact with the metal plate 3 (first conductor) and at least partially overlapping a surface of the loop antenna 11, the surface being opposite to a surface facing the reader/writer 120. The overlapping of the metal foil 4 with a part of the loop antenna 11 causes a magnetic field to be repelled in the overlapped part of the loop antenna 11, thereby controlling the inductive coupling in the overlapping area, promoting the concentration of magnetic flux onto a non-overlapping area, and improving communication performance.

In other words, magnetic flux that comes from the reader/writer through the loop antenna 11 causes current to flow in opposite directions between the one side section 11*a* on which the lead wire of the coil is wound in one direction and the other side section 11*b* on which the lead wire of the coil is wound in another direction, and, as a result, efficient coupling is prevented.

Hence, in the antenna device 1, the metal foil 4 is made to partially overlap a surface of the loop antenna 11, the surface being opposite to a surface facing the reader/writer 120, thereby repelling a magnetic field in the overlapping area, controlling inductive coupling in the overlapping area, and efficiently transmitting current generated in the non-overlapping area. Furthermore, in the antenna device 1, the metal foil 4 is made to partially overlap a surface of the loop antenna 11, the surface being opposite to a surface facing the reader/writer 120, thereby concentrating magnetic flux onto the non-overlapping area and promoting efficient power generation in the non-overlapping region.

In the antenna device 1, the metal foil 4 also overlaps or is in contact with the metal plate 3, and accordingly, without leakage of magnetic flux from the metal plate 3, the magnetic flux can be induced to the area of the loop antenna 11 not overlapped by the metal foil 4, allowing inductive coupling to be performed efficiently. By the metal foil 4 also overlapping the metal plate 3 in the antenna device 1, current generation caused by in inductive coupling, in a part overlapped by the metal foil 4, due to leaked magnetic flux from the metal plate 3 can be prevented.

As the metal foil 4, a good conductor, such as a copper foil, is preferably employed, but use of a good conductor is not necessary. The thickness of the metal foil 4 may be suitably determined according to the communication frequency between the antenna device 1 and the reader/writer 120. For example, at a communication frequency of 13.56 MHz, a metal foil having a thickness of 20 μm to 30 μm may be used.

As long as the metal foil 4 overlaps the metal plate 3 or the loop antenna 11, the metal foil 4 does not necessary need to to be in a state of contact. Placing the metal foil 4 closer to the metal plate 3 and the loop antenna 11, however, is more advantageous for coupling coefficient, and therefore the metal foil 4 is preferably adjacent to or in contact with the metal plate 3 or the loop antenna 11.

Figure 7:
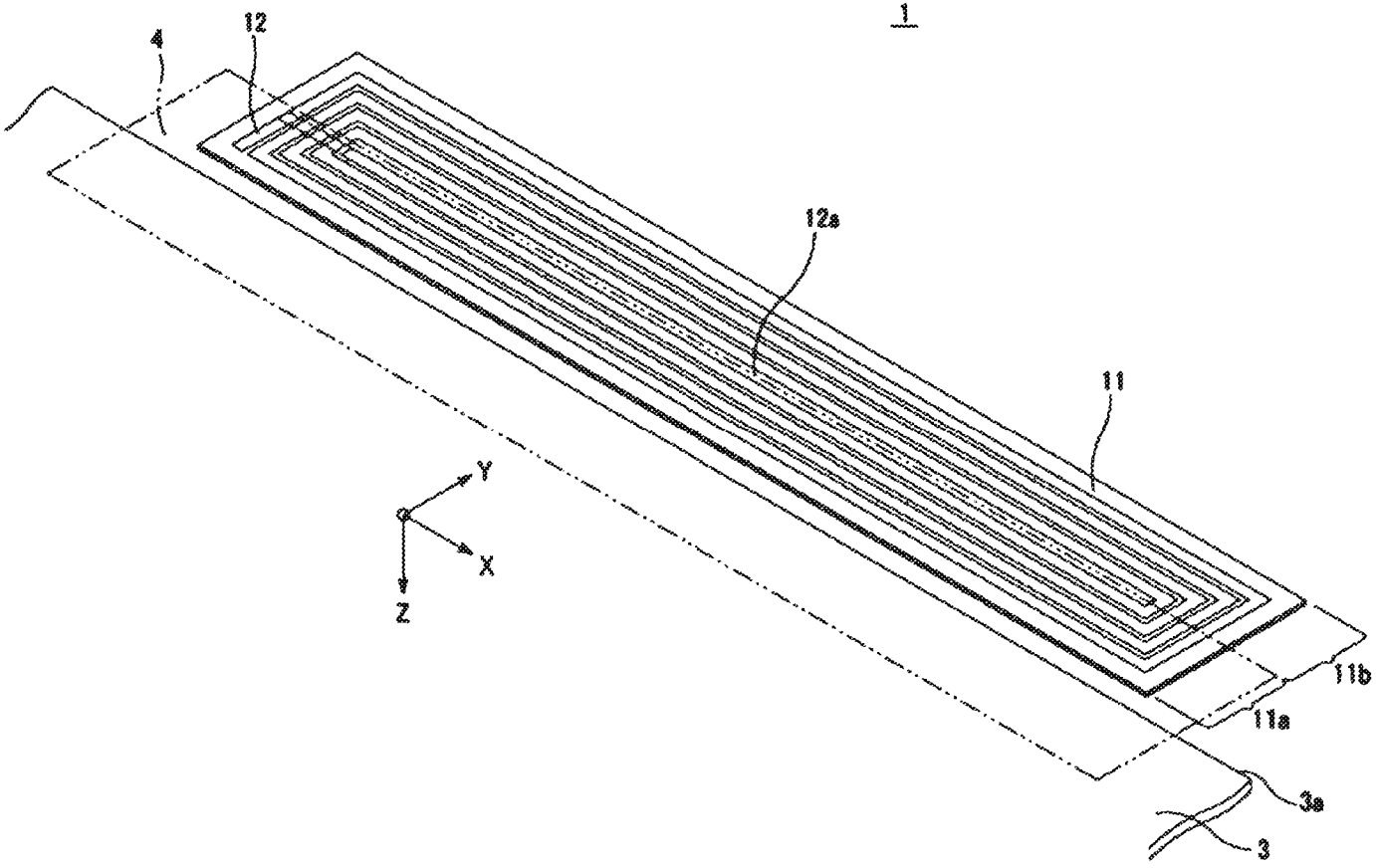
FIG. 7 is a perspective view illustrating a state in which a metal foil overlaps with one side of an antenna substrate over the whole length in a longitudinal direction.

As illustrated in FIG. 7, the metal foil 4 preferably overlaps from an end portion of the one side section 11*a* of the loop antenna 11 to the central section 12*a* of the antenna coil 12. Thus, the metal foil 4 can control the coupling in the one side section 11*a* of the loop antenna 11, thereby making a relative reduction in the amount of current flowing in a direction opposite to current generated in the other side section 11*b*, and the metal foil 4 can induce magnetic flux from the one side section 11*a* to the other side section 11*b* thereof, thereby promoting the coupling in the other side section 11*b* and improving communication characteristics.

As illustrated in FIG. 7, the metal foil 4 preferably has a width of at least the width in the longitudinal direction of the one side section 11*a* of the loop antenna 11 and overlaps with the one side section 11*a* of the loop antenna 11 completely over the longitudinal direction. In this way as well, the metal foil 4 can control the inductive coupling in the one side section 11*a* of the loop antenna 11, thereby making a relative reduction in the amount of current flowing in a direction opposite to current generated in the other side section 11*b*, and the metal foil 4 can induce magnetic flux from the one side section 11*a* of the loop antenna 11 to the other side section 11*b* thereof, thereby promoting the coupling in the other side section 11*b*. and improving communication characteristics In the preceding explanation, a configuration of the antenna device 1 in the wireless communication system 100 is explained for a basic structure in which the loop antenna 11 has an approximately rectangular shape and the lead wire of the antenna coil 12 is wound around along the outline thereof as illustrated in FIG. 2. In the case of a mobile apparatus such as the smart phone 130, the edge of a metal plate typically coincides with the edge of the mobile apparatus due to the internal structure thereof and metal plates or metal bodies are often present in multiple layers such that the effect of being substantially disposed at the edge is not gained due to the influence of a distant layer relative to an opposing antenna. Therefore, in the antenna device 1 to which the present disclosure is applied, a magnetic sheet 110 is disposed on the surface of a metal body 111 disposed at a distant position relative to the antenna 121 of the opposing reader/writer 120.

Figure 8:
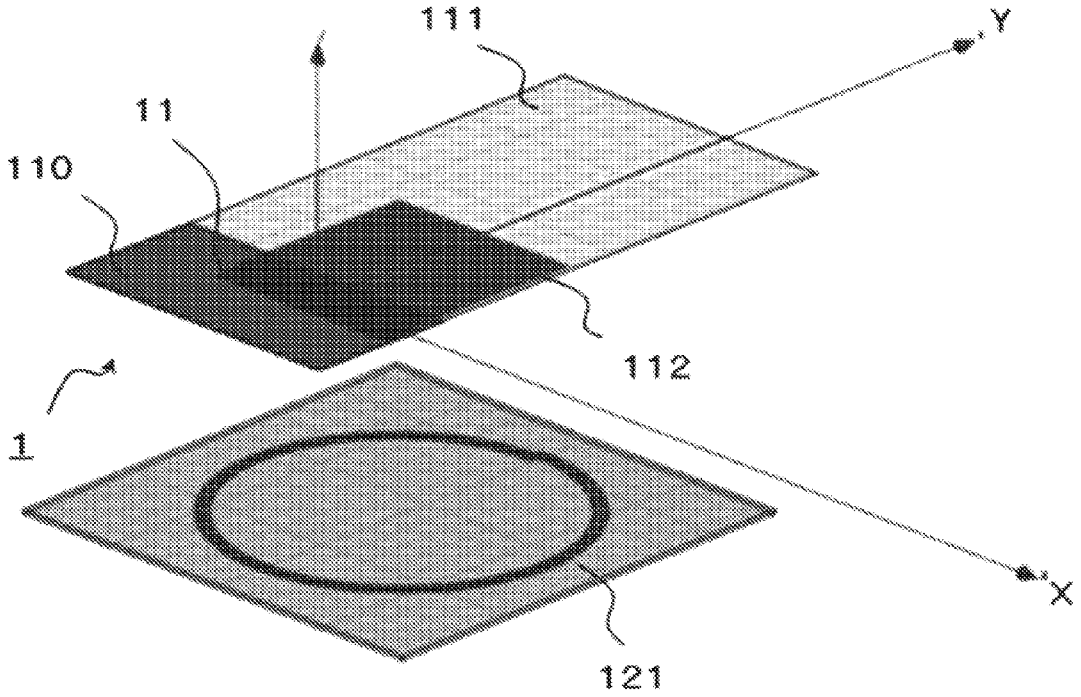
FIG. 8 is a perspective view schematically illustrating an example of configuration of an antenna device to which the present disclosure is applied.

More specifically, the antenna coil 12 of the loop antenna 11 in the antenna device 1 to which the present disclosure is applied is for example adopted in an electronic apparatus, such as the smart phone 130, including a metal body 111, a metal plate 112, and so forth in multiple layers, as illustrated in FIG. 8, and the magnetic sheet 110, which is composed of a metal sheet with a magnetic shielding function, is attached to an inner wall surface of a metal body, such as a cover 111 made from a non-magnetic metal, disposed at a distant position relative to the antenna 121 of the opposing reader/writer 120. The magnetic sheet 110 preferably covers from a center line of the antenna coil 12 of the loop antenna 11 to a front edge of the cover 111 made from the non-magnetic metal.

Figure 9A:
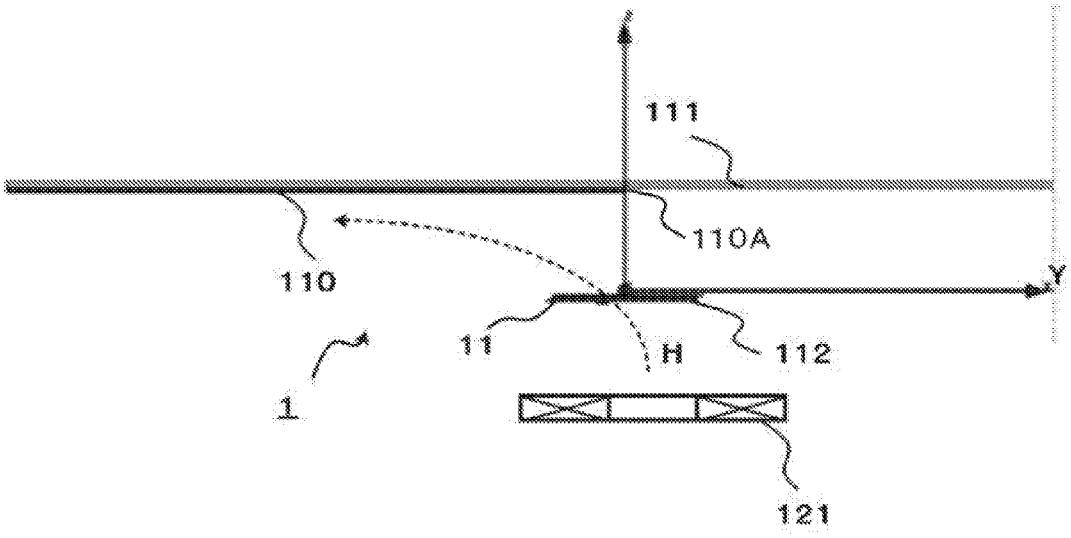
FIG. 9A is a longitudinal side view of overall configuration and FIG. 9B is an enlarged longitudinal side view of an antenna coil section, each schematically illustrating the main aspects of configuration of the antenna device.
Figure 9B:
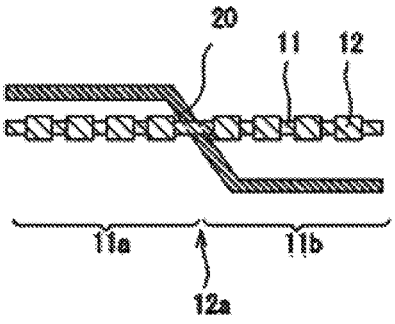

By positioning the antenna coil 12 as illustrated in FIG. 9 such that the central section 12*a* of the antenna coil 12 coincides with an edge 110A of the magnetic sheet 110, the antenna coil 12 is bisected into the one side section 11*a* and the other side section 11*b* of the loop antenna 11 by the center line thereof such that the one side section 11*a* of the loop antenna 11 opposes the magnetic sheet 110 and the other side section 11*b* of the loop antenna 11 opposes the cover 111 made from the non-magnetic metal via the other metal plate 112 and so forth in-between.

In the antenna device 1 described above in which the magnetic sheet 110 is disposed on the surface of the metal body 111 disposed at the distant position relative to the antenna 121 of the opposing reader/writer 120, a magnetic field H transmitted from the antenna 121 of the reader/writer 120 is reliably pulled into the magnetic sheet 110 via a central aperture of the antenna coil 12.

In the loop antenna 11 illustrated in FIG. 9, a magnetic sheet 20 is inserted into the central aperture of the antenna coil 12. In other words, the magnetic sheet 20 is inserted into the central aperture in the central section 12*a* of the antenna coil 12 such that at the one side section 11*a* of the loop antenna 11, the antenna coil 12 is closer than the magnetic sheet 20 to the reader/writer 120 and at the other side section 11*b* of the loop antenna 11, the magnetic sheet 20 is closer than the antenna coil 12 to the reader/writer 120.

The loop antenna 11 has a structure in which the central aperture extends in the longitudinal direction in the central section 12*a* of the antenna coil 12 and the magnetic sheet 20 is inserted into the central aperture. In other words, the magnetic sheet 20 is inserted into the central section 12*a* of the antenna coil 12, which is formed on a printed substrate, such that the antenna coil 12 and the magnetic sheet 20 overlap one another to satisfy two positional requirements: a positional requirement that the magnetic sheet 20 is closer than the antenna coil 12 to the reader/writer 120 on a central aperture side opposing the reader/writer 120; and a positional requirement that the antenna coil 12 is closer than the magnetic sheet 20 to the reader/writer 120 on a magnetic sheet 110 side.

Inserting the magnetic sheet 20 into the central aperture of the antenna coil 12 as described above can improve communication characteristics by further improving efficiency of pulling in the magnetic field H transmitted from the antenna 121 such that a large electromotive force is generated in the antenna coil 12 through the guided magnetic field.

Figure 10A:
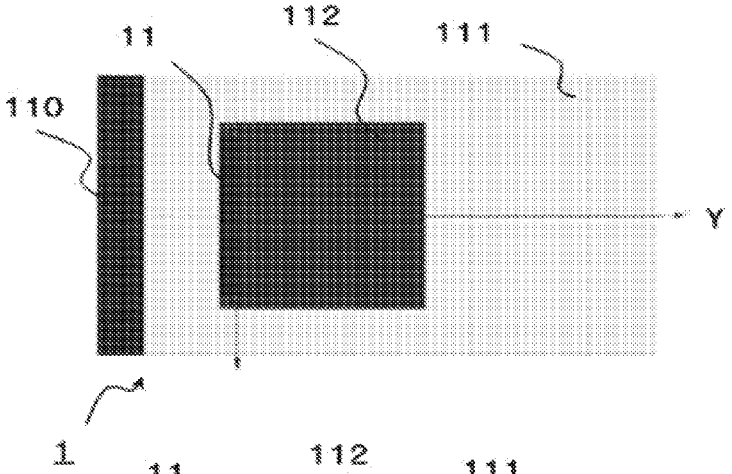
FIGS. 10A, 10B and 10C are plan views illustrating states in which the size of a magnetic sheet in the antenna device is varied.
Figure 10B:
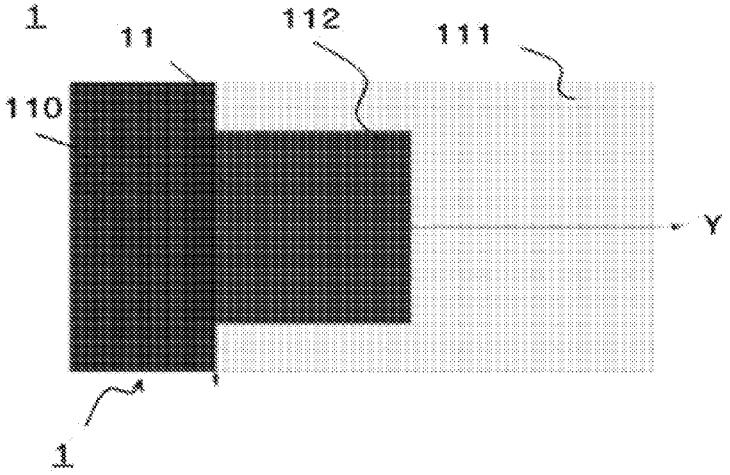
Figure 10C:
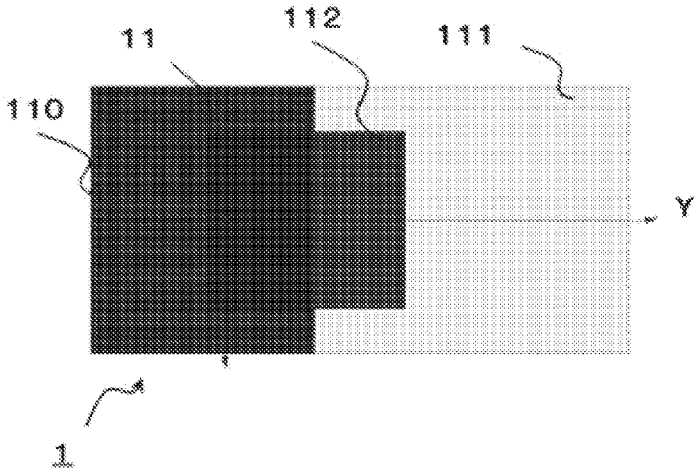
Figure 11:
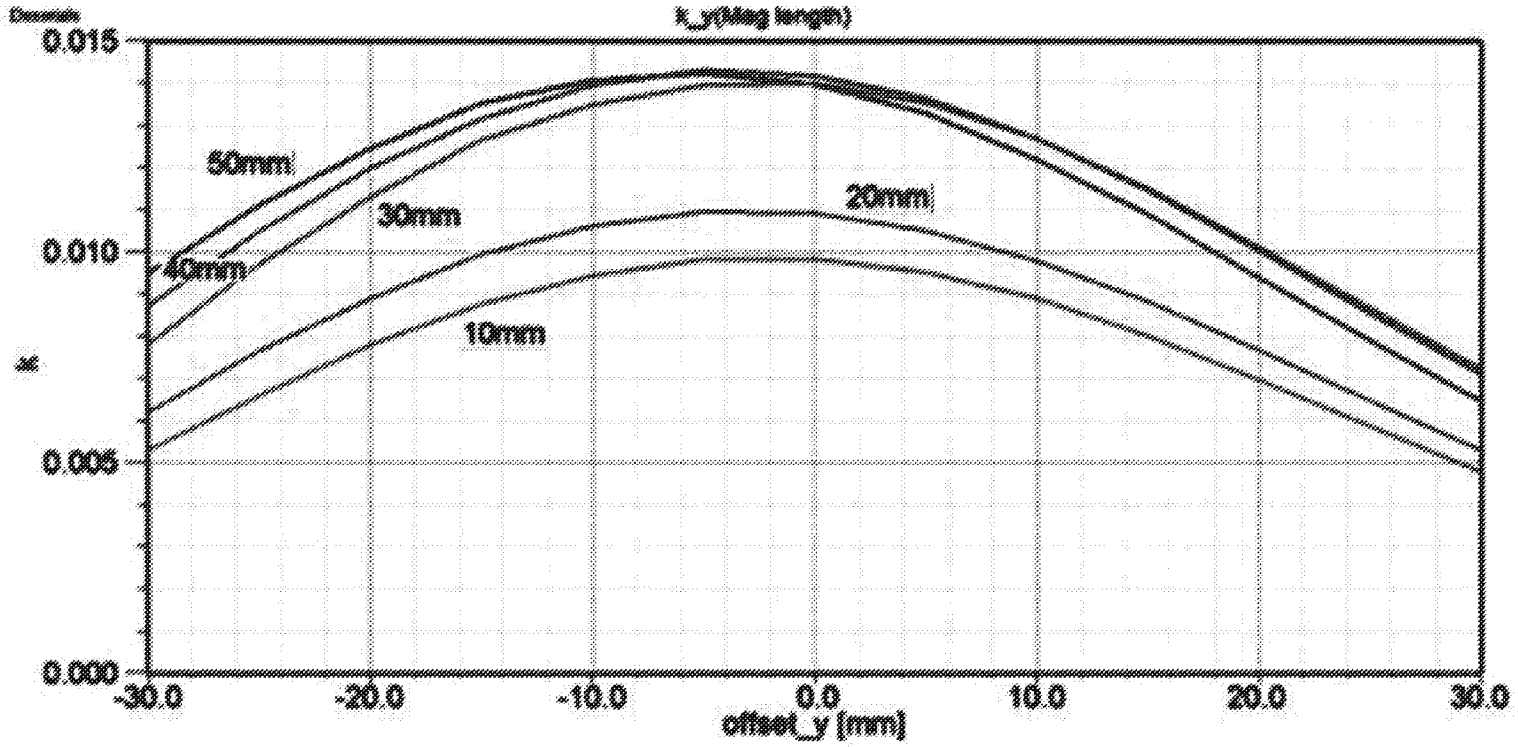
FIG. 11 illustrates results for a coupling coefficient of the antenna device in a simulation in which an antenna of an opposing reader/writer was moved in a Y direction.

FIG. 11 illustrates results for the coupling coefficient in a simulation in which the antenna 121 of the opposing reader/writer 120 was moved in the Y direction with respect to the antenna device 1 having the configuration described above and in which the size of the magnetic sheet 110 was varied as illustrated in (A), (B), and (C) of FIG. 10.

In the simulation, the antenna 121 of the reader/writer 120 was a two-wind coil having an outline measuring 66 mm×100 mm. The metal body 111 disposed at the distant position relative to the antenna 121 of the reader/writer 120 was stainless steel measuring 120 mm×60 mm×0.3 mm. The NFC antenna coil—that is, the antenna coil 12 of the loop antenna 11—measured 40 mm×8 mm. The distance from the metal body 111 to the antenna 121 of the reader/writer 120 was 5 mm. The size of the magnetic sheet 110 attached to the inner wall surface of the metal body 111 was 10 mm×60 mm in sample 1 illustrated in FIG. 10A, 30 mm×60 mm in sample 2 illustrated in FIG. 10B, and 50 mm×60 mm in sample 3 illustrated in FIG. 10C. Each of samples 1-3 was evaluated.

As illustrated by the results in FIG. 11 of the simulation in which the coupling coefficient was obtained while moving the antenna 121 of the opposing reader/writer 120 in the Y direction with respect to each of samples 1-3, the best characteristics were achieved when the magnetic sheet 110 had a length extending from the front edge of the metal body 111 to the center of the NFC antenna coil—that is the antenna coil 12 of the loop antenna 11.

Figure 12A:
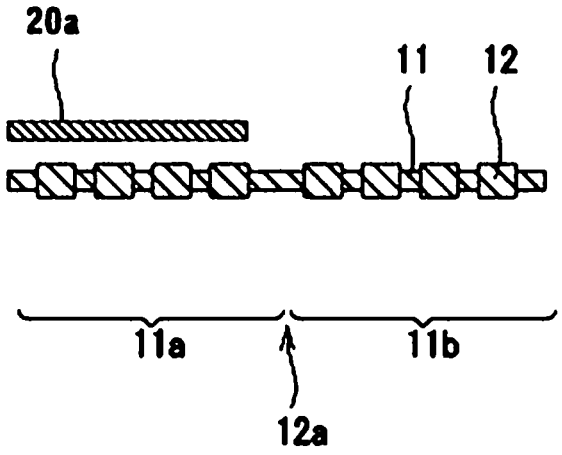
FIGS. 12A and 12B are cross-sectional views schematically illustrating other examples of positioning of the magnetic sheet in the antenna device.
Figure 12B:
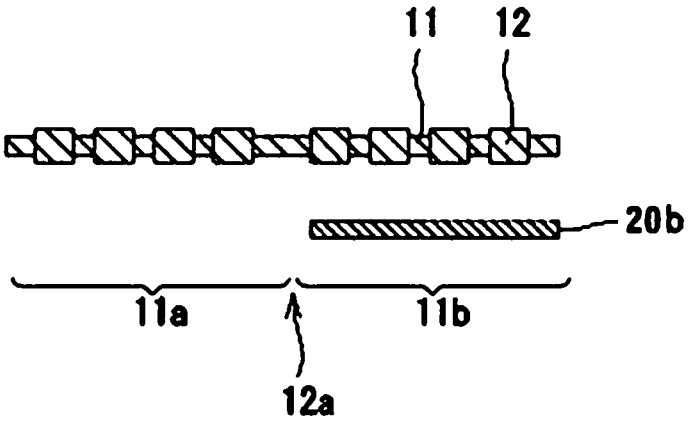

Note that the magnetic field H transmitted from the antenna 121 can be efficiently pulled into the antenna coil 12 and communication characteristics can be improved even in a structure which includes, instead of the magnetic sheet 20 inserted into the central aperture of the antenna coil 12, a magnetic sheet 20*a* that is disposed closer than the antenna coil 12 to the magnetic sheet 110 and opposing the one side section 11*a* of the antenna coil 12 as illustrated in FIG. 12A, or a magnetic sheet 20*b* that is disposed closer than the antenna coil 12 to the reader/writer 120 and opposing the other side section 11*b* of the antenna coil 12 as illustrated in FIG. 12B.

REFERENCE SIGNS LIST

1 antenna device
2 antenna module
3 metal plate
4 metal foil
11 loop antenna
12 antenna coil
13 communication processor
14 terminal
20, 20*a*, 20*b* magnetic sheet
110 magnetic sheet
110A edge
111 metal body
112 metal plate
120 reader/writer
121 antenna
141 outer casing
141*a* inner circumference wall
142 space

The invention claimed is:

1. An antenna device that is incorporated into an electronic apparatus and that is configured to communicate with an external device via an electromagnetic field signal, the antenna device comprising:

first and second conductors arranged in multiple layers, the first conductor being disposed farther than the second conductor relative to an antenna of the external device;

a first magnetic sheet attached to an inner wall surface of the first conductor; and an antenna coil bisected into one side section and the other side section of a loop antenna along an edge of the first magnetic sheet, the loop antenna having one surface arranged to face the external device at the time of communication and an opposite surface at least partially overlapping the second conductor, wherein the one side section of the loop antenna opposes the first magnetic sheet and the other side section of the loop antenna opposes the first conductor via the second conductor in-between on the opposite surface of the loop antenna.

2. The antenna device of claim 1, further comprising a second magnetic sheet that at a side corresponding to the one side section of the antenna coil, is disposed closer than the antenna coil to the first magnetic sheet and opposing the one side section of the antenna coil, and at a side corresponding to the other side section of the antenna coil, is disposed closer than the antenna coil to the external device and opposing the other side section of the antenna coil.

3. The antenna device of claim 1, further comprising a third magnetic sheet disposed closer than the antenna coil to the first magnetic sheet and opposing the one side section of the antenna coil, or a fourth magnetic sheet disposed closer than the antenna coil to the external device and opposing the other side section of the antenna coil.

4. An electronic apparatus into which an antenna device is incorporated that is configured to communicate with an external device via an electromagnetic field signal, the electronic apparatus comprising:

first and second conductors arranged in multiple layers, the first conductor being disposed farther than the second conductor relative to an antenna of the external device;

a first magnetic sheet attached to an inner wall surface of the first conductor; and an antenna coil that is bisected into one side section and the other side section of a loop antenna along an edge of the first magnetic sheet, the loop antenna having one surface arranged to face the external device at the time of communication and an opposite surface at least partially overlapping the second conductor, wherein the one side section of the loop antenna opposes the first magnetic sheet and the other side section of the loop antenna opposes the first conductor via the second conductor in-between on the opposite surface of the loop antenna.

5. The electronic apparatus of claim 4, wherein the first magnetic sheet is attached to the inner wall surface of the first conductor so as to cover from a center line of the antenna coil to a front edge of the first conductor.

6. The electronic apparatus of claim 5, further comprising a second magnetic sheet that at a side corresponding to the one side section of the antenna coil, is disposed closer than the antenna coil to the first magnetic sheet and opposing the one side section of the antenna coil, and at a side corresponding to the other side section of the antenna coil, is disposed closer than the antenna coil to the external device and opposing the other side section of the antenna coil.

7. The electronic apparatus of claim 5, further comprising a third magnetic sheet disposed closer than the antenna coil to the first magnetic sheet and opposing the one side section of the antenna coil, or a fourth magnetic sheet disposed closer than the antenna coil to the external device and opposing the other side section of the antenna coil.

* * * * *